US012760633B2

(12) United States Patent
Heliot et al.

(10) Patent No.: US 12,760,633 B2
(45) Date of Patent: Oct. 13, 2026

(54) SYSTEMS AND METHODS FOR HORIZONTAL WELLS FOR IN-SITU MINING WITH OR WITHOUT ELECTROKINETIC ASSISTANCE

(71) Applicant: Schlumberger Technology Corporation, Sugar Land, TX (US)

(72) Inventors: Denis Heliot, Sugar Land, TX (US); Lina Xu, Houston, TX (US); Rod Shampine, Houston, TX (US); Amol Bhome, Sugar Land, TX (US); Gritsadapong Leaungvongpaisan, Bangkok (TH)

(73) Assignee: Schlumberger Technology Corporation, Sugar Land, TX (US)

( * ) Notice: Subject to any disclaimer, the term of this patent is extended or adjusted under 35 U.S.C. 154(b) by 129 days.

(21) Appl. No.: 18/774,343

(22) Filed: Jul. 16, 2024

(65) Prior Publication Data

US 2026/0022631 A1 Jan. 22, 2026

(51) Int. Cl.
*E21B 43/24* (2006.01)
*E21B 43/28* (2006.01)

(52) U.S. Cl.
CPC ..... *E21B 43/283* (2013.01)

(58) Field of Classification Search
CPC ..... E21B 43/283; E21B 43/305; E21B 43/24; E21B 43/30; E21B 7/046; E21B 43/34; E21B 43/162; E21B 43/14
See application file for complete search history.

(56) References Cited

U.S. PATENT DOCUMENTS 4,221,433 A * 9/1980 Jacoby ..... E21B 43/305 299/4
8,381,810 B2 * 2/2013 Dreher, Jr. ..... E21B 43/243 166/256

(Continued)

FOREIGN PATENT DOCUMENTS

WO 2023220785 A1 11/2023

OTHER PUBLICATIONS

Martens et al., Toward a more sustainable mining future with electrokinetic in situ leaching, Science Advances, vol. 7, No. 18, Apr. 30, 2021, 10 pages.

(Continued)

*Primary Examiner* — Carib A Oquendo
(74) *Attorney, Agent, or Firm* — Jeffrey D. Frantz

(57) ABSTRACT

Systems and methods for horizontal wells for in-situ mining are provided. A system for in-situ mining includes: an injection well including: a first vertical portion (VP) extending downward from a ground surface, the first VP receiving a lixiviant, and a first horizontal portion (HP) connected to the first VP and extending horizontally through the ground, the first HP receiving the lixiviant from the first VP, and injecting the lixiviant into the ground to dissolve a target material forming a solution, and a production well including: a second HP extending horizontally parallel to the first HP through the ground, the second HP receiving the solution from the first HP, and a second VP connected to the second HP and extending upward to the ground surface, the second VP: receiving the solution from the second HP, and pumping the solution to a processing plant to separate the target material from the lixiviant.

19 Claims, 7 Drawing Sheets

(56) References Cited

U.S. PATENT DOCUMENTS

| | | | | |
|---|---|---|---|---|
| 9,291,043 | B1 * | 3/2016 | Affholter | E21B 43/2408 |
| 2011/0272153 | A1 * | 11/2011 | Boone | E21B 43/26 166/52 |
| 2015/0204179 | A1 * | 7/2015 | Affholter | E21B 43/24 166/245 |
| 2019/0368330 | A1 | 12/2019 | Hardage | |
| 2020/0088010 | A1 | 3/2020 | Longo | |
| 2021/0032970 | A1 * | 2/2021 | Li | E21C 41/16 |
| 2021/0254445 | A1 | 8/2021 | Goldsmith | |
| 2022/0074019 | A1 * | 3/2022 | Verba | C22B 3/165 |
| 2023/0160373 | A1 * | 5/2023 | Steele | E21B 43/12 60/641.2 |

OTHER PUBLICATIONS

Way, Shao-Chih, Well-Field Mechanics for In-Situ Mining, In-Situ, Inc., Ft. Collins, Colorado, Nov. 2013, 3 pages.

* cited by examiner

SYSTEMS AND METHODS FOR HORIZONTAL WELLS FOR IN-SITU MINING WITH OR WITHOUT ELECTROKINETIC ASSISTANCE

TECHNICAL FIELD

This disclosure generally relates to systems and methods for horizontal wells for in-situ mining, and more particularly, systems and methods for horizontal wells for in-situ mining with or without electrokinetic assistance.

BACKGROUND

Modern mining techniques can be generally categorized into three types: open pits ("surface mining"), underground mining, and in-situ mining. Over time, there are less materials available close to the surface, making surface mining less useful for reaching desirable materials, such as metals, including, but not limited to, copper, lithium, gold, uranium, rare earth elements (REE), etc. Long-term sustainability is also an issue with open pit and underground mining. For example, there is a large impact on soil, water, and air quality. Also, there are concerns about safety, such as a dam bursting, earth moving, or holes in the ground causing problems when using open pit and traditional underground mining. In contrast, in-situ mining, also known as in-situ leaching, in-situ recovery, solution mining, etc., is scalable to smaller or larger deposits of target materials, requires lower capital and operation cost than open pits or underground mining that requires large equipment, has a smaller overall environmental impact than the other mining techniques, and is safer than the other mining techniques.

In-Situ mining traditionally includes providing a series of vertical wells, including injectors (or "injection wells"), producers (or "production wells"), and control wells (or "monitor wells"). It relies on the right lixiviant reaching the ores and freeing the metal to enrich the solution being circulated from the injection to the production well. The extraction of target minerals or materials by this technique requires that the target be soluble, e.g., potash, potassium chloride, sodium chloride, sodium sulfate, which dissolve in water. Some minerals, such as copper minerals, lithium, and uranium oxide, require a liquid medium as a lixiviant, such as acid or carbonate solutions, or a brine, to dissolve. Gold, for example, may use cyanide, chlorine, bromine, or iodine as a lixiviant. An oxidant, such as oxygen and/or hydrogen peroxide mixed with sodium carbonate or carbon dioxide, may be used as a lixiviant for uranium. The lixiviant is injected into the target mineral via one or more injector wells. The target mineral is dissolved by the lixiviant and the lixiviant mixed with the target mineral, which may be referred to as a "pregnant lixiviant" or "pregnant solution" is pumped via one or more producer wells to the surface. The pregnant lixiviant is then processed to separate the target mineral from the lixiviant to recover the target mineral. Different patterns of injection and production wells can be used. Control wells are usually drilled around those wells to ensure that groundwater is not contaminated.

FIG. 1 is a cross-sectional diagram of an in-situ mining operation according to a related art. FIG. 2 is a set of diagrams of example arrangements for vertical wells for an in-situ mining operation according to a related art.

FIG. 1 shows a mining area 100 in which control wells 105, 110, 115 are on a periphery of the mining area 100 to monitor for groundwater contamination. The control wells 105, 110, 115 can pass through and/or end at any of the various layers of the ground, e.g., a top layer 120, sands/clays/gravels 125, an upper clay layer 130, a target layer 135, and/or a lower clay layer 140. An injection well 145 pumps the lixiviant from a production plant (not shown) from the surface into the target layer 135. A production well 150 pumps the pregnant lixiviant solution containing the target material from the target layer 135 back to the production plant on the surface.

FIG. 2 shows examples of some patterns of injection wells and production wells used for vertical wells for in-situ mining. In FIG. 2, production wells are shown as triangles and injection wells are shown as circles. Parts (a)-(e) show five examples of arrays of vertical well arrangements. Part (a) illustrates a "five-spot" arrangement in which injection wells and production wells are evenly distributed and alternate across the area. Part (b) illustrates a "seven-spot" arrangement in which each injection well is surrounded by six production wells. Part (c) illustrates an "inverted seven-spot" arrangement in which each production well is surrounded by six injection wells. Part (d) illustrates a "direct line drive" arrangement in which rows of injection wells alternate with rows of production wells, forming columns of alternating injection and production wells. Part (e) illustrates a "staggered line drive" arrangement in which rows of injection wells alternate with rows of production wells, but the column spacing of the production wells are between pairs of injection wells. Vertical wells may be about 20 meters apart.

FIG. 3 is a diagram of electrokinetic in-situ leaching (EK-ISL) for an in-situ mining operation according to a related art.

Electrokinetic in-situ leaching (EK-ISL) may be used to assist the in-situ mining process. A description of EK-ISL is made by Evelien Martens et al., "Toward a more sustainable mining future with electrokinetic in situ leaching," *Science Advances,* 7, eabf9971 (2021), DOI:10.1126/sciadv.abf9971, pp. 1-10 (https://www.science.org/doi/10.1126/sciadv.abf9971). FIG. 3, which was published in the above reference, provides a 3D isometric view of an industrial-scale EK-ISL operation in Part (a), including potential electrode configuration, above-ground energy source, lixiviant supply and recovery reservoirs connected to vertical wells, and metal recovery treatment facility. Part (b) shows a cross-sectional view of the ore interface between an anode well and a cathode well. Part (c) illustrates principal hydrogeochemical reactions between the lixiviant and the ore material when subjected to EK-driven electromigration.

When using EK-ISL, an electric field is created between one well (or "borehole") acting as an anode and one well acting as a cathode. This is generally performed by applying a low-voltage DC current. EK-ISL is combined with the injection of lixiviant to help the lixiviant reach the metal and/or metal-rich minerals in the rocks, then EK-ISL controls the transport of the pregnant solution to the production well.

However, even with EK-ISL, in-situ mining using vertical wells has some drawbacks. For example, there is a large footprint, covering the entire field or area of interest, which makes mining in populated areas difficult. There is a need to construct many wells (or "boreholes") extending to the surface over the entire area of interest. If there is an impermeable formation between the ore deposit and the groundwater, using vertical wells means having many holes drilled through the impermeable formation, which increases groundwater contamination risks. Also, when using EK-ISL, the wells should be close enough together for EK-ISL to work effectively, which increases the number of wells needed to be drilled and maintained.

Accordingly, there is a need for systems and methods for horizontal wells for in-situ mining. There is also a need for systems and methods for horizontal wells for in-situ mining with or without electrokinetic assistance.

SUMMARY

This disclosure pertains to systems and methods for horizontal wells for in-situ mining with or without electrokinetic assistance.

Example embodiments of the present disclosure may include two horizontal (or highly deviated) wells (or "boreholes") drilled alongside each other through an ore-bearing formation. One well may act as an injector for the lixiviant solution, and the other well may act as a producer for the pregnant solution, e.g., the solution rich in target metal(s). The two well may be next to each other, or one above the other.

A first aspect of this disclosure pertains to a system for in-situ mining, including: an injection well in an area of interest, the injection well including: a first vertical portion extending downward from a ground surface, the first vertical portion being configured to receive a lixiviant from a lixiviant source, and a first horizontal portion connected to the first vertical portion, the first horizontal portion extending horizontally across the area of interest through a permeable ground layer, the first horizontal portion being configured to: receive the lixiviant from the first vertical portion, and inject the lixiviant into the permeable ground layer to dissolve a target material to form a solution containing the lixiviant and the target material, and a production well in the area of interest, the production well including: a second horizontal portion, the second horizontal portion extending horizontally across the area of interest parallel to the first horizontal portion through the permeable ground layer, the second horizontal portion being configured to receive the solution from the first horizontal portion, and a second vertical portion connected to the second horizontal portion, the second vertical portion extending upward to the ground surface, the second vertical portion being configured to: receive the solution from the second horizontal portion, and pump the solution to a processing plant to separate the target material from the lixiviant.

A second aspect of this disclosure pertains to the system of the first aspect, wherein: the injection well is closer to the ground surface than the production well, or the production well is closer to the ground surface than the injection well.

A third aspect of this disclosure pertains to the system of the first aspect, wherein: electrokinetic in-situ leaching (EK-ISL) is applied to the injection well and the production well, one of the injection well and the production well is an anode, and the other of the injection well and the production well is a cathode.

A fourth aspect of this disclosure pertains to the system of the first aspect, wherein at least a portion of the first horizontal portion of the injection well is at a same distance to the ground surface as at least a portion of the second horizontal portion of the production well.

A fifth aspect of this disclosure pertains to the system of the first aspect, wherein: the injection well is provided in plurality, the production well is provided in plurality, the plurality of injection wells and the plurality of production wells overlap as respective pairs in a depth direction, and a plurality of the pairs are provided across the area of interest.

A sixth aspect of this disclosure pertains to the system of the first aspect, wherein: the injection well is provided in plurality, the production well is provided in plurality, the plurality of injection wells alternates with the plurality of production wells across the area of interest such that the plurality of injection wells and the plurality of production wells do not overlap in a depth direction.

A seventh aspect of this disclosure pertains to the system of the first aspect, wherein: a plurality of the first horizontal portions is connected to the first vertical portion of the injection well, and a plurality of the second horizontal portions is connected to the second vertical portion of the production well.

An eighth aspect of this disclosure pertains to the system of the seventh aspect, wherein at least part of the plurality of the first horizontal portions of the injection well and the plurality of the second horizontal portions of the production well overlap in a depth direction.

A ninth aspect of this disclosure pertains to the system of the first aspect, wherein at least a portion of the first horizontal portion of the injection well and at least a portion of the second horizontal portion of the production well extend under a populated area, an agricultural area, or a developed area.

A tenth aspect of this disclosure pertains to the system of the first aspect, and further includes: a plurality of control wells arranged at a periphery of the area of interest, wherein the control wells are configured to monitor groundwater in the area of interest.

An eleventh aspect of this disclosure pertains to the system of the first aspect, wherein: the first horizontal portion and the second horizontal portion are each sectioned into a plurality of zones, each zone of the first horizontal portion is paired with a respective zone of the second horizontal portion, and a first pair of first horizontal portion zone and second horizontal portion zone is independently operable from a second pair of first horizontal portion zone and second horizontal portion zone.

A twelfth aspect of this disclosure pertains to a method for in-situ mining, the method including: providing an injection well in an area of interest, the providing the injection well including: providing a first vertical portion extending downward from a ground surface, the first vertical portion being configured to receive a lixiviant from a lixiviant source, and providing a first horizontal portion connected to the first vertical portion, the first horizontal portion extending horizontally across the area of interest through a permeable ground layer, the first horizontal portion: receiving the lixiviant from the first vertical portion, and injecting the lixiviant into the permeable ground layer to dissolve a target material to form a solution containing the lixiviant and the target material, and providing a production well in the area of interest, the providing the production well including: providing a second horizontal portion, the second horizontal portion extending horizontally across the area of interest parallel to the first horizontal portion through the permeable ground layer, the second horizontal portion receiving the solution from the first horizontal portion, and providing a second vertical portion connected to the second horizontal portion, the second vertical portion extending upward to the ground surface, the second vertical portion: receiving the solution from the second horizontal portion, and pumping the solution to a processing plant to separate the target material from the lixiviant.

A thirteenth aspect of this disclosure pertains to the method of the twelfth aspect, wherein: the injection well is closer to the ground surface than the production well, or the production well is closer to the ground surface than the injection well.

A fourteenth aspect of this disclosure pertains to the method of the twelfth aspect, wherein: electrokinetic in-situ leaching (EK-ISL) is applied to the injection well and the production well, one of the injection well and the production well is an anode, and the other of the injection well and the production well is a cathode.

A fifteenth aspect of this disclosure pertains to the method of the twelfth aspect, wherein: a plurality of control wells is arranged at a periphery of the area of interest, and the control wells monitor groundwater in the area of interest.

A sixteenth aspect of this disclosure pertains to the method of the twelfth aspect, wherein: the first horizontal portion and the second horizontal portion are each sectioned into a plurality of zones, each zone of the first horizontal portion is paired with a respective zone of the second horizontal portion, and a first pair of first horizontal portion zone and second horizontal portion zone is independently operable from a second pair of first horizontal portion zone and second horizontal portion zone.

A seventeenth aspect of this disclosure pertains to the method of the sixteenth aspect, wherein: the lixiviant is injected into the first pair of the first horizontal portion zone and the second horizontal portion zone, and simultaneously, the lixiviant is not injected into the second pair of the first horizontal portion zone and the second horizontal portion zone.

An eighteenth aspect of this disclosure pertains to the method of the seventeenth aspect, wherein, at a different point in time: the lixiviant is injected into the second pair of the first horizontal portion zone and the second horizontal portion zone, and simultaneously, the lixiviant is not injected into the first pair of the first horizontal portion zone and the second horizontal portion zone.

A nineteenth aspect of this disclosure pertains to the method of the sixteenth aspect, wherein a composition of the solution is measured on a zone-by-zone basis.

A twentieth aspect of this disclosure pertains to the method of the sixteenth aspect, wherein: fracking or re-fracking is performed in the first pair of the first horizontal portion zone and the second horizontal portion zone, and simultaneously, the fracking or the re-fracking is not performed in the second pair of the first horizontal portion zone and the second horizontal portion zone.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF DRAWINGS

To describe the manner in which the above-recited and other features of the disclosure can be obtained, a more particular description will be rendered by reference to specific implementations thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example implementations, the implementations will be described and explained with additional specificity and detail through the use of the accompanying drawings in which.

Figure 1:
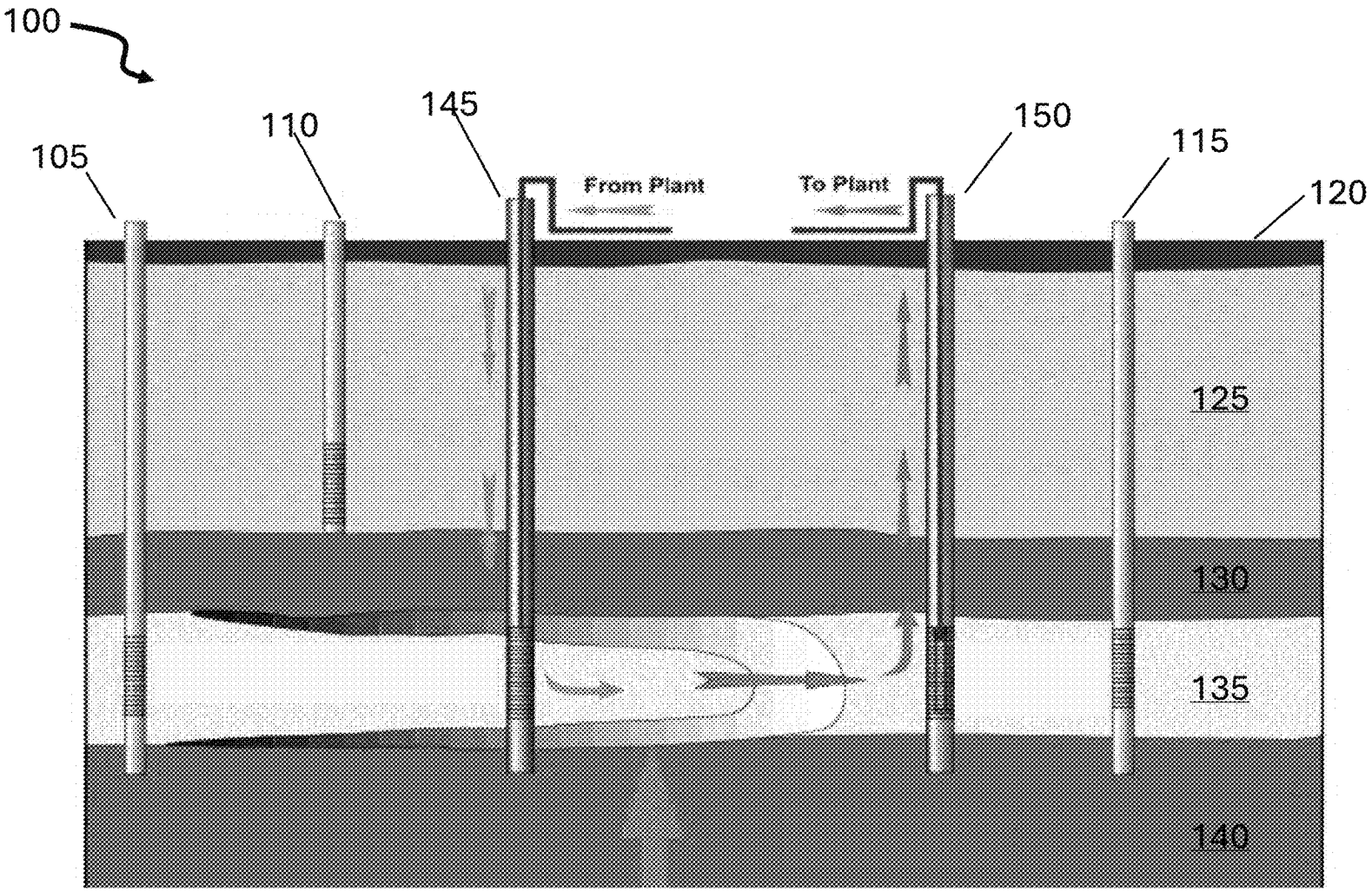
FIG. 1 (Related Art)
FIG. 1 is a cross-sectional diagram of an in-situ mining operation according to a related art.

Before any embodiments are explained in detail, it is to be understood that the disclosure is not limited in its application to the details of the configuration and arrangement of components set forth in the following description or illustrated in the accompanying drawings. The disclosure is capable of being practiced or of being carried out in various ways. Also, it is to be understood that the phraseology and terminology used herein are for the purpose of description and should not be regarded as limiting. The use of "including," "comprising," or "having" and variations thereof are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

DETAILED DESCRIPTION

While the subject disclosure applies to embodiments in many different forms, there are shown in the drawings and will be described in detail herein specific embodiments with the understanding that the present disclosure is an example of the principles of the invention. It is not intended to limit the invention to the specific illustrated embodiments. The features disclosed herein in the description, drawings, and claims can be significant, both individually and in any desired combinations, for the operation of the disclosure in its various embodiments. Features from one embodiment can be used in other embodiments. In the description of the drawings, like reference numerals refer to like elements.

Figure 4:
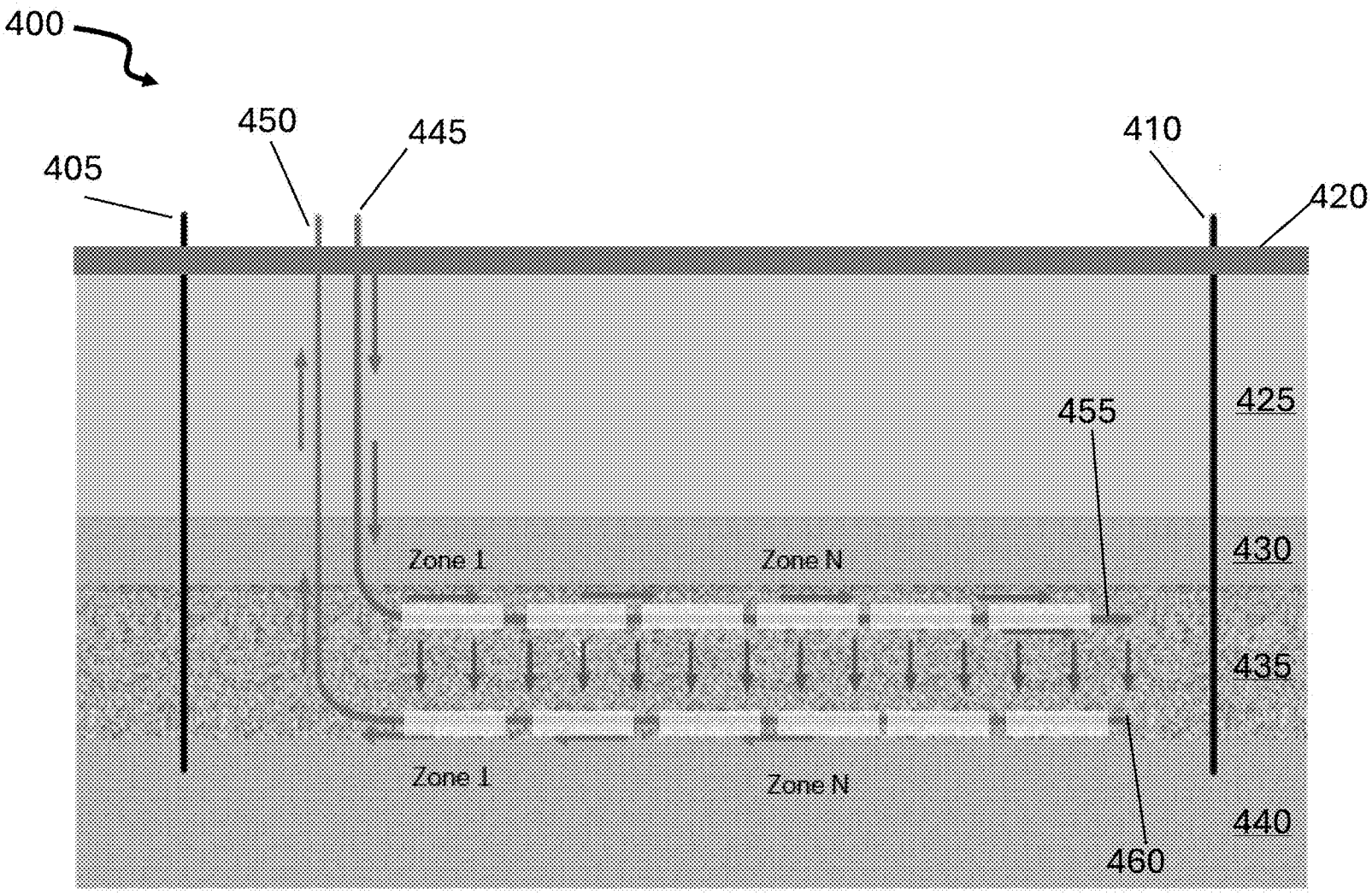
FIG. 4 is a cross-sectional diagram of an in-situ mining operation in accordance with an example embodiment of the present disclosure.
Figure 5:
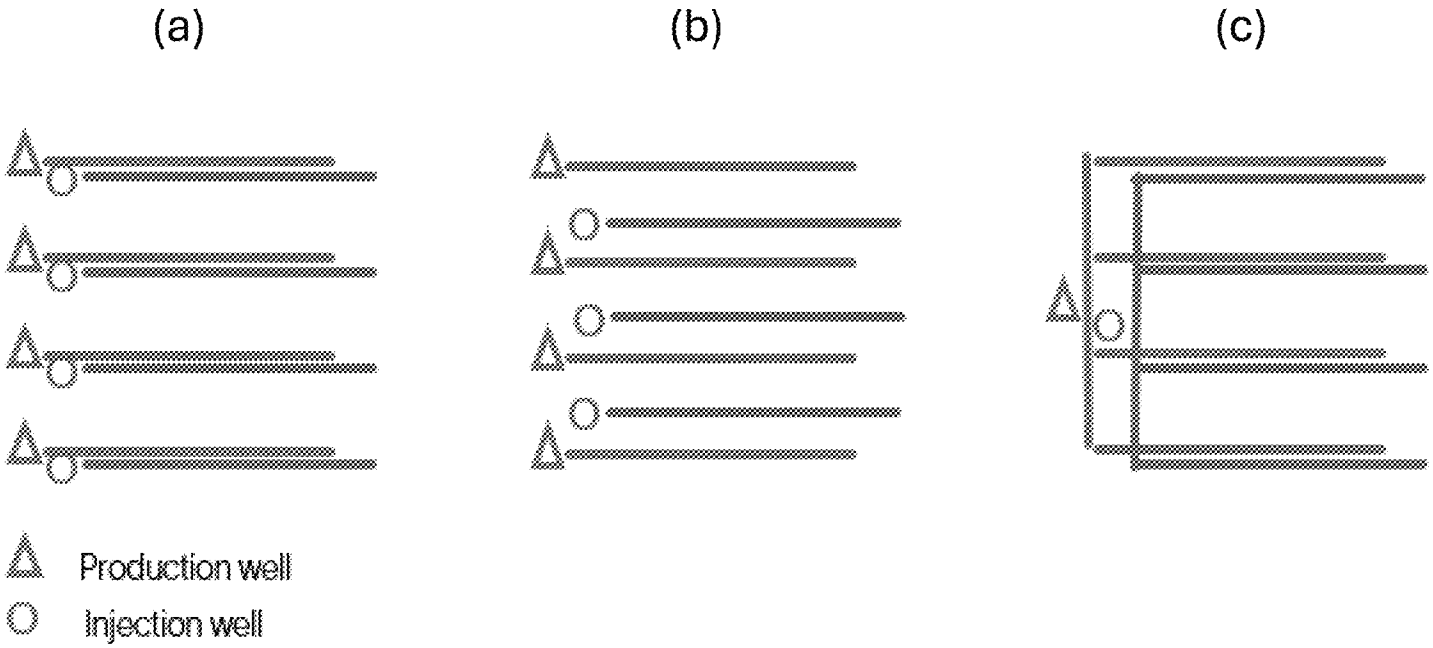
FIG. 5 is a set of diagrams of example arrangements for horizontal wells for an in-situ mining operation in accordance with an example embodiment of the present disclosure.
Figure 6:
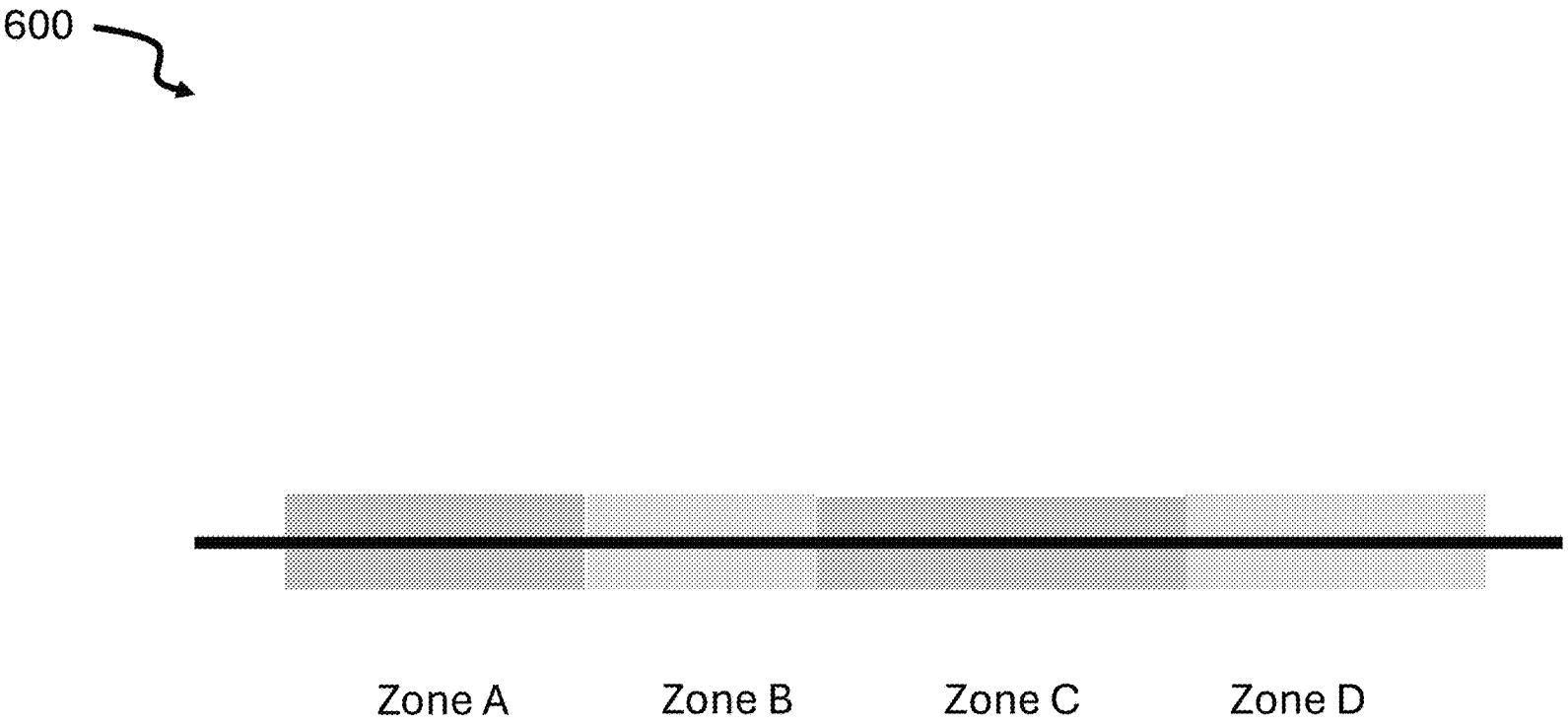
FIG. 6 is a schematic map view of a horizontal portion of a horizontal well in accordance with an example embodiment of the present disclosure.

FIG. 4 is a cross-sectional diagram of an in-situ mining operation in accordance with an example embodiment of the present disclosure. FIG. 5 is a set of diagrams of example arrangements for horizontal wells for an in-situ mining operation in accordance with an example embodiment of the present disclosure. FIG. 6 is a schematic map view of a horizontal portion of a horizontal well in accordance with an example embodiment of the present disclosure.

With reference to FIG. 4, in a mining area 400, control wells 405, 410 may be on a periphery of the mining area 400 to monitor for groundwater contamination. The control wells 405, 410 can pass through and/or end at any of the various layers of the ground, e.g., a top layer 420, sands/clays/gravels 425, an upper clay layer 430, a target layer 435, and/or a lower clay layer 440. A vertical injection well portion 445 may pump the lixiviant from a production plant (not shown) from the surface into a horizontal injection well portion 455 in the target layer 435. A vertical production well portion 450 may pump the pregnant lixiviant solution containing the target material from a horizontal production well portion 460 in the target layer 435 back to the production plant on the surface. The terms "well" and "borehole" are used interchangeably herein. The horizontal injection well portion 455 and the horizontal production well portion 460 may be provided as pipes, and may include multiple holes or perforations along their respective lengths. The pipes may include, for example, metal, fiberglass, or any other material generally known for mining pipes.

FIG. 4 illustrates two horizontal (or highly deviated) wells (or "boreholes") drilled alongside each other through the ore-bearing formation. One well may act as an injector for the lixiviant solution, and the other well may act as a producer for the "pregnant" solution, e.g., a solution rich in the target material, e.g., metal(s) or mineral(s). In some example embodiments, the injector may be the upper well. Injection could be passive, for example, in case of dry rock, and may rely on gravity. Alternatively, or in addition, injection can be active, and may provide various levels of flow rate over time. In other examples, the injection could be done from the lower well. For example, the production could use buoyancy of the pregnant liquid to assist in pumping the target material up to the production plant. The direction of the flow of the lixiviant is shown in FIG. 4 by arrows between the horizontal injection well portion 455 and the horizontal production well portion 460. However, the flow direction may be reversed, depending on the operational parameters of the mining being performed. In an example in which electrokinetic in-situ leaching (EK-ISL) is used to improve, accelerate, and/or control production, one zone in one of the injection or production wells may act as anode while another zone in the other production or injection well may act as a cathode. An injection well may be below or above a production well. While the wells may be at a same level, e.g., side-by-side, such an arrangement may not be able to take advantage of gravity or buoyancy to assist the pumping and/or EK-ISL operation.

More than two horizontal wells can be drilled, creating various patterns of injectors and producers (and anodes/cathodes if EK-ISL is used). The well pairs (or multiple well patterns) can be "deviated" instead of horizontal. For instance, the wells may be positioned along dipping fault planes or quartz veins. The wells may follow a path that maximizes access to the target material. For example, the wells may be under, above, or within a cap or shell layer (or another type of rock that prevents escape of the target material), may have an optimized path, may be in a permeable layer, or may be formation-free.

The term "horizontal" is not limited to an x-axis direction or a direction 90° from a y-axis (or "depth") direction in a cross-section of the ground, and is not limited to parallel to a ground surface. Rather, as used herein, "horizontal" refers to a portion of the well that is at least 45° from a y-axis direction, and may be 60° or more from a y-axis direction in practice. The term "vertical" is not limited to a y-axis direction or a direction 90° from an x-axis direction, and is not limited to normal to a ground surface. Rather, as used herein, "vertical" refers to a portion of the well that is at least 45° from an x-axis direction, and may be 60° or more from an x-axis direction in practice. Each well (or "borehole") will have at least one horizontal portion connected to a vertical portion, where the vertical portion reaches up to the ground surface. Both of the horizontal portion(s) and the vertical portion may vary in angle as desired for the particular mining conditions, as should be understood to one of ordinary skill in the art. As used herein, the terms "well" and "borehole" are used interchangeably.

In FIG. 5, production wells are shown as triangles and injection wells are shown as circles. Parts (a)-(c) show three non-limiting examples of arrays of horizontal well portion arrangements. Part (a) illustrates an arrangement in which vertical portions of injection wells and production wells are paired close together in rows along a single column that spans across the area. For example, the injection wells and production wells may be substantially overlapping in a y-axis direction in a cross-section. Part (b) illustrates an arrangement in which vertical portions of injection wells alternate with vertical portions of production wells, with production wells at the top and bottom of the single column that spans across the area. Part (c) illustrates an arrangement in which one injection well and one production well each extends and divides from a single vertical well section into multiple horizontal well portions. For example, each horizontal well portion can be associated with a respective vertical well portions as in examples (a) and (b), or multiple horizontal well portions may extend laterally from the same shared vertical well portion as in example (c).

Figure 2:
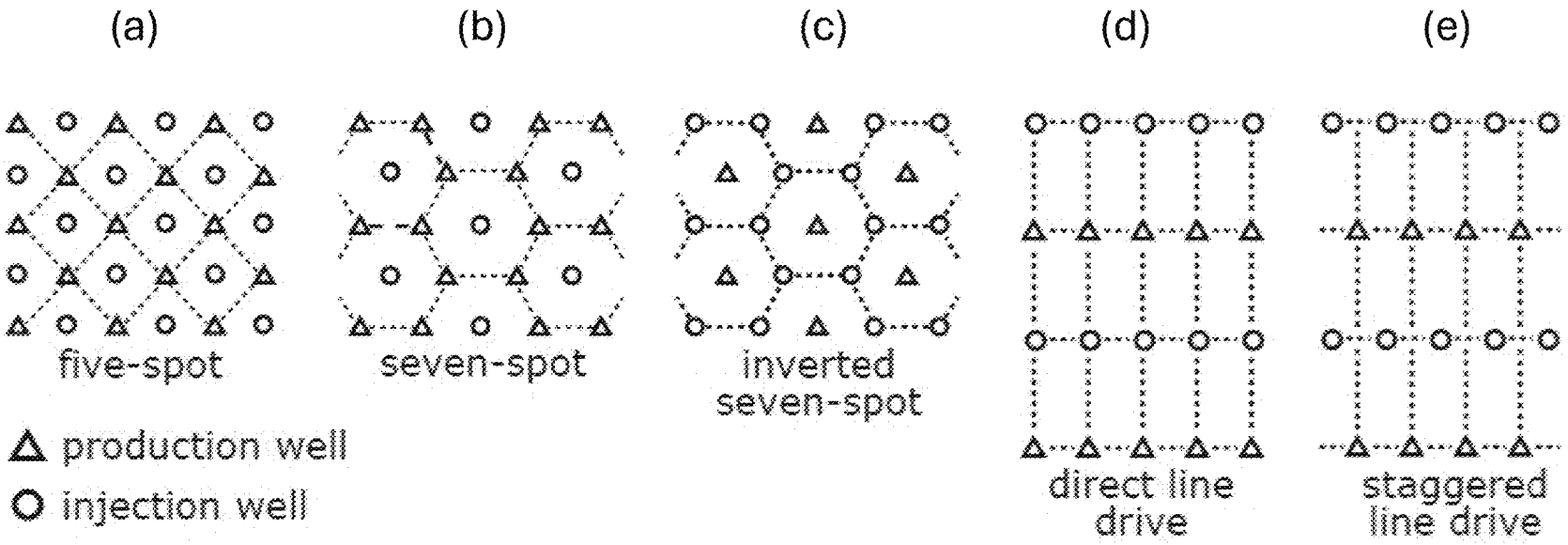
FIG. 2 (Related Art)
FIG. 2 is a set of diagrams of example arrangements for vertical wells for an in-situ mining operation according to a related art.
Figure 3:
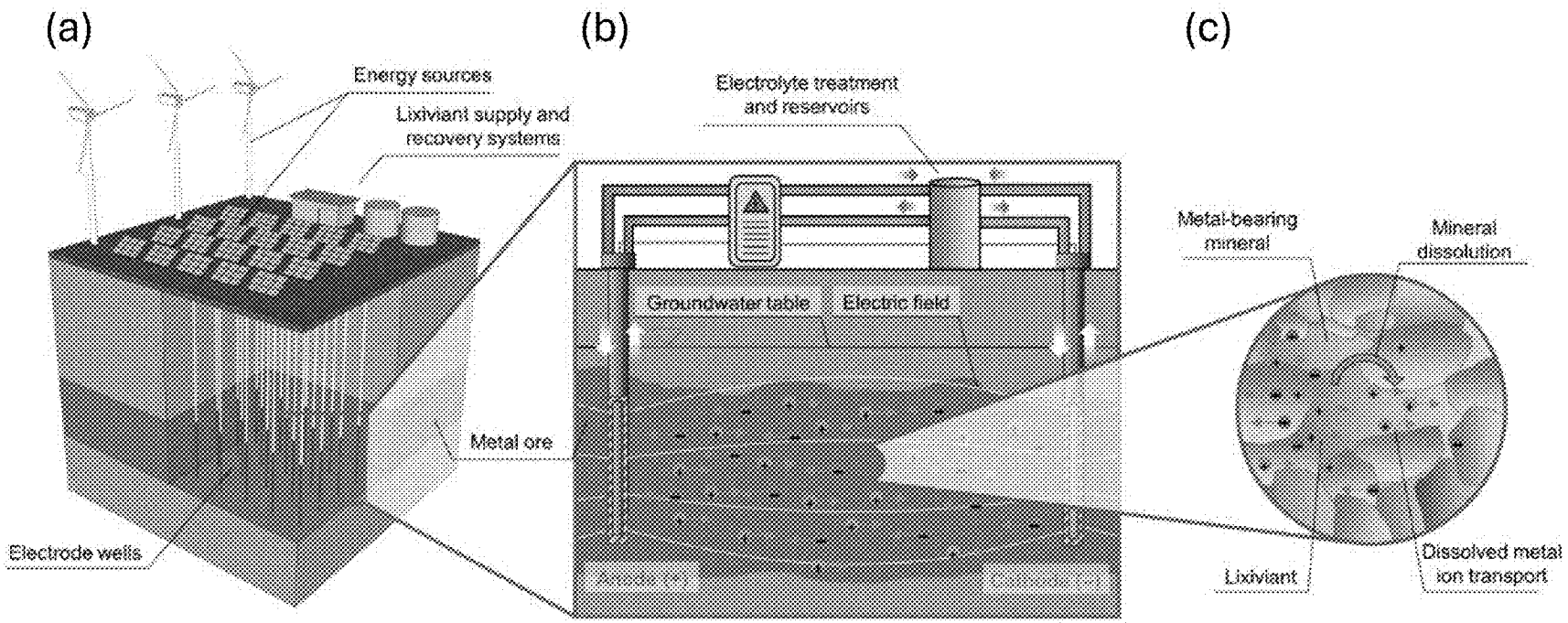
FIG. 3 (Related Art)
FIG. 3 is a diagram of electrokinetic in-situ leaching (EK-ISL) for an in-situ mining operation according to a related art.

It should be appreciated that other patterns of horizontal wells may be used within the scope of embodiments of the present disclosure. For example, any of the patterns may be repeated over a large area, e.g., with multiple "columns" of horizontal wells and/or multiple horizontal wells in a "row" in which each horizontal well extends over an area in which multiple vertical wells in the FIG. 2 related art examples would have been used. Nor are the number of branching horizontal portions branching from a single vertical portion limited to the illustrated example (c). Moreover, example embodiments include a mix of horizontal and vertical injector and producer well portions in the same mine. Also of note, any well (or multiple wells) can be operated as an injector at some point in time, and may then be converted to operate as a producer later, and vice versa. In one example, the horizontal portions of the wells may extend under a populated area, such as a town or farm, without having above-surface visibility or noticeable effect in the populated area.

With reference again to FIG. 4, the horizontal wellbores, e.g., the horizontal injection well portion 455 and the horizontal production well portion 460, can be segmented into zones, e.g., Zone 1 . . . Zone N.

FIG. 6 shows an example of a horizontal well 600 with four zones, Zones A-D, illustrated, although example embodiments may have more or fewer zones. The zones can be of the same or different lengths, and while the example shown in FIG. 6 illustrates zones of different lengths, embodiments are not limited thereto. In FIG. 6, the horizontal injection well portion and the horizontal production well portion are shown together as being paired in each zone, such that each injector/producer zone pair is operable together. The size of each zone may be arbitrary as desired for the operational use of the zone. As an example, each zone in the horizontal injection well portion 455 may have a corresponding zone in the horizontal production well portion 460; the corresponding zones may have the same size, although the sizes may be different. Alternatively, each zone in the horizontal injection well portion 455 may have a directly corresponding zone in the horizontal production well portion 460. For example, each well may be zoned independently. The sizing and location of zones used in injection and production wells may depend, for example, on geology (e.g., permeability, mineralogy break-down, permeability, presence of natural fractures, etc.), on the configuration of the well and the parts/equipment used, and on the production strategy/plan.

In an example embodiment using zones, injections of lixiviant and production of "pregnant lixiviant" can be done on a zone-by-zone basis. Some example advantages of using zones include: (a) avoiding leakage in fracture/fault zones, (b) optimizing parameters for each zone, (c) optimizing the overall injection/production from the wells, (d) performing fracking or inflow control device (ICD) drilling on a zone-by-zone basis (as in multi-stage fracking). Each zone may be operated independently, which may be one at a time or operating only selected zones at any given time. For example, the lixiviant may be injected in any one or more selected zones and simultaneously not injected in any one or more other zones. At a different point in time, the lixiviant may be injected into the previously-unselected zone(s) and simultaneously not injected into the originally-selected zone(s). A composition of the solution may be measured on a zone-by-zone basis. This can allow for adjustment of operation or zone selection to extract the target material more efficiently and/or perform the mining operation more efficiently and/or cost-effectively. The composition of the solution may be measured in the producer well. Furthermore, a concentration of the lixiviant may be set to be different in different zones in the injection well. The concentration of the lixiviant may be separately measured in different zones. Also, fracking and/or re-fracking may be performed in any one or more selected zones and simultaneously not performed in any one or more other zones, and the selection of operating zones may be changed over time.

In an example embodiment in which EK-ISL is used, EK-ISL can also be done on a zone-by-zone basis. Some example advantages of zone usage with EK-ISL include: (a) managing the electricity power needed for EK-ISL operation, and (b) mitigating problems related to extreme pH values close to the anode and cathode system. Using zones may allow the in-situ mining operation to (a) skip zones that are not productive and/or where lixiviant could become lost in the natural fracture network of the ground, e.g., in the target layer 435, (b) optimize parameters of operation for each zone, e.g., pump rate or chemical mixture per zone, (c) vary EK-ISL power per zone, which may use less overall power, (d) activate zones selectively, and/or (e) recycle lixiviant that was used in one zone to use for other zones.

Figure 7:
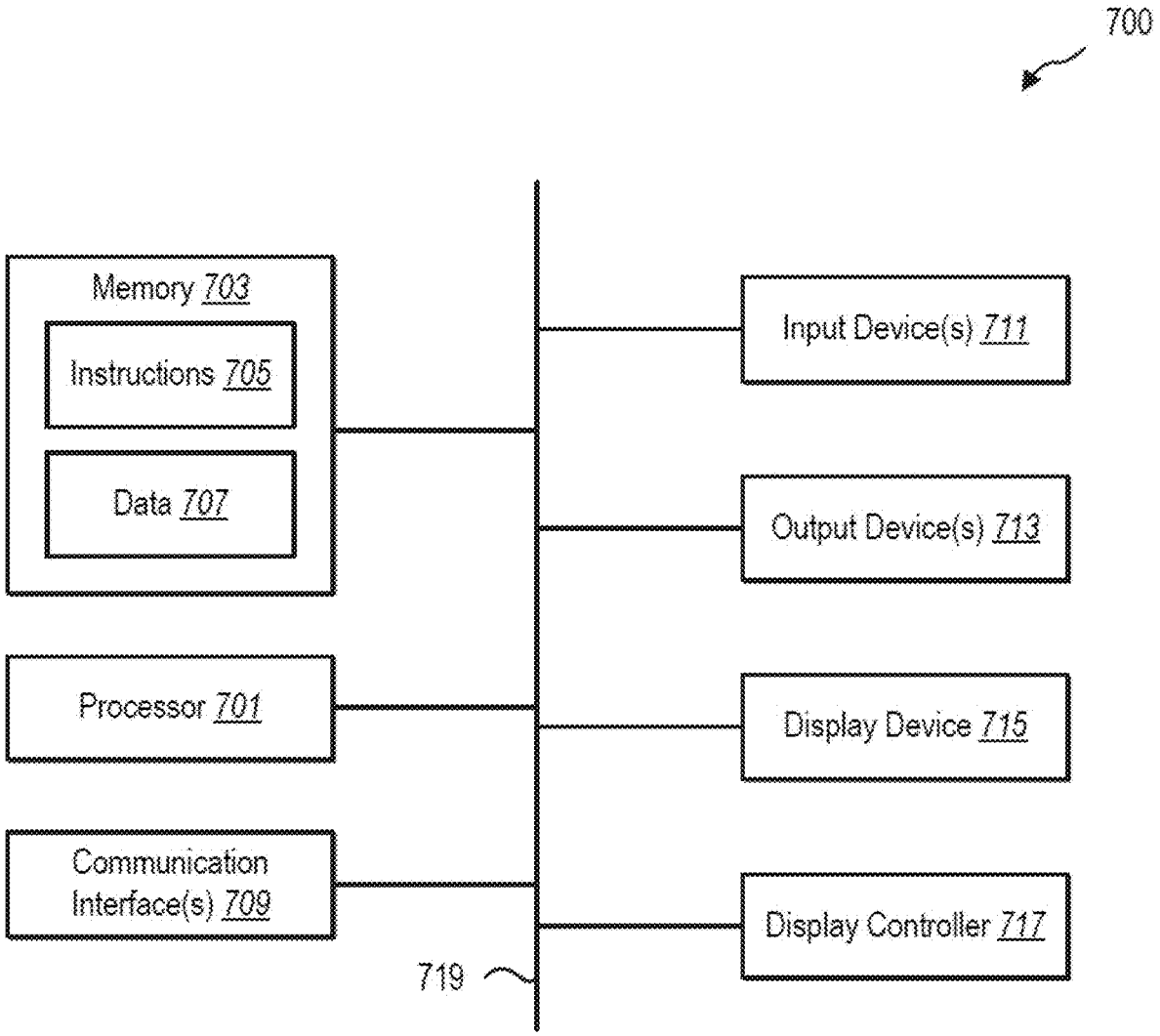
FIG. 7 illustrates certain components that may be included within a computer system according to an example embodiment of the present disclosure.

FIG. 7 illustrates certain components that may be included within a computer system according to an example embodiment of the present disclosure.

FIG. 7 illustrates certain components that may be included within a computer system 700, which may be used to control the horizontal wells of FIGS. 4-5. One or more computer systems 700 may be used to implement the various devices, components, and systems described herein.

The computer system 700 includes a processor 701. The processor 701 may be a general-purpose single- or multi-chip microprocessor (e.g., an Advanced RISC (Reduced Instruction Set Computer) Machine (ARM)), a special-purpose microprocessor (e.g., a digital signal processor (DSP)), a microcontroller, a programmable gate array, etc. The processor 701 may be referred to as a central processing unit (CPU). Although just a single processor 701 is shown in the computer system 700 of FIG. 7, in an alternative configuration, a combination of processors (e.g., an ARM and DSP) could be used. In one or more embodiments, the computer system 700 further includes one or more graphics processing units (GPUs), which can provide processing services related to both entity classification and graph generation.

The computer system 700 also includes memory 703 in electronic communication with the processor 701. The memory 703 may be any electronic component capable of storing electronic information. For example, the memory 703 may be embodied as random access memory (RAM), read-only memory (ROM), magnetic disk storage media, optical storage media, flash memory devices in RAM, on-board memory included with the processor, erasable programmable read-only memory (EPROM), electrically erasable programmable read-only memory (EEPROM), registers, and so forth, including combinations thereof.

Instructions 705 and data 707 may be stored in the memory 703. The instructions 705 may be executable by the processor 701 to implement some or all of the functionality disclosed herein. Executing the instructions 705 may involve the use of the data 707 that is stored in the memory 703. Any of the various examples of modules and components described herein may be implemented, partially or wholly, as instructions 705 stored in memory 703 and executed by the processor 701. Any of the various examples of data described herein may be among the data 707 that is stored in memory 703 and used during execution of the instructions 705 by the processor 701.

A computer system 700 may also include one or more communication interfaces 709 for communicating with other electronic devices. The communication interface(s) 709 may be based on wired communication technology, wireless communication technology, or both. Some examples of communication interfaces 709 include a Universal Serial Bus (USB), an Ethernet adapter, a wireless adapter that operates in accordance with an Institute of Electrical and Electronics Engineers (IEEE) 802.11 wireless communication protocol, a Bluetooth® wireless communication adapter, and an infrared (IR) communication port.

A computer system 700 may also include one or more input devices 711 and one or more output devices 713. Some examples of input devices 711 include a keyboard, mouse, microphone, remote control device, button, joystick, trackball, touchpad, and lightpen. Some examples of output devices 713 include a speaker and a printer. One specific type of output device that is typically included in a computer system 700 is a display device 715. Display devices 715 used with embodiments disclosed herein may utilize any suitable image projection technology, such as liquid crystal display (LCD), light-emitting diode (LED), gas plasma, electroluminescence, or the like. A display controller 717 may also be provided, for converting data 707 stored in the memory 703 into text, graphics, and/or moving images (as appropriate) shown on the display device 715.

The various components of the computer system 700 may be coupled together by one or more buses, which may include a power bus, a control signal bus, a status signal bus, a data bus, etc. For the sake of clarity, the various buses are illustrated in FIG. 7 as a bus system 719.

Systems and software, e.g., implemented on a non-transitory computer-readable medium, for performing the methods discussed herein are also within the scope of embodiments of the present disclosure.

Embodiments of the present disclosure may thus utilize a special purpose or general-purpose computing system including computer hardware, such as, for example, one or more processors and system memory. Embodiments within the scope of the present disclosure also include physical and other computer-readable media for carrying or storing computer-executable instructions and/or data structures, including applications, tables, data, libraries, or other modules used to execute particular functions or direct selection or execution of other modules. Such computer-readable media can be any available media that can be accessed by a general purpose or special purpose computer system. Computer-readable media that store computer-executable instructions (or software instructions) are physical storage media. Computer-readable media that carry computer-executable instructions are transmission media. Thus, by way of example, and not limitation, embodiments of the present disclosure can include at least two distinctly different kinds of computer-readable media, namely physical storage media or transmission media. Combinations of physical storage media and transmission media should also be included within the scope of computer-readable media.

Both physical storage media and transmission media may be used temporarily to store or carry, software instructions in the form of computer readable program code that allows performance of embodiments of the present disclosure. Physical storage media may further be used to persistently or permanently store such software instructions. Examples of physical storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored as or in software, hardware, firmware, or combinations thereof.

A "network" or "communications network" may generally be defined as one or more data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instructions or data structures and which can be accessed by a general purpose or special purpose computer.

Further, upon reaching various computer system components, program code in the form of computer-executable instructions or data structures can be transferred automatically or manually from transmission media to physical storage media (or vice versa). For example, computer-executable instructions or data structures received over a network or data link can be buffered in memory (e.g., RAM) within a network interface module (NIC), and then eventually transferred to computer system RAM and/or to less volatile physical storage media at a computer system. Thus, it should be understood that physical storage media can be included in computer system components that also (or even primarily) utilize transmission media.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

The invention claimed is:

1. A system for in-situ mining, comprising:

an injection well in an area of interest, the injection well comprising:

a first vertical portion extending downward from a ground surface, the first vertical portion being configured to receive a lixiviant from a lixiviant source; and a first horizontal portion connected to the first vertical portion, the first horizontal portion extending horizontally across the area of interest through a permeable ground layer, the first horizontal portion being configured to:

receive the lixiviant from the first vertical portion; and inject the lixiviant into the permeable ground layer to dissolve a target material to form a solution containing the lixiviant and the target material; and a production well in the area of interest, the production well comprising:

a second horizontal portion, the second horizontal portion extending horizontally across the area of interest parallel to the first horizontal portion through the permeable ground layer, the second horizontal portion being configured to receive the solution from the first horizontal portion; and a second vertical portion connected to the second horizontal portion, the second vertical portion extending upward to the ground surface, the second vertical portion being configured to:

receive the solution from the second horizontal portion; and pump the solution to a processing plant to separate the target material from the lixiviant, wherein:

electrokinetic in-situ leaching (EK-ISL) is applied to the injection well and the production well, one of the injection well and the production well is an anode, and the other of the injection well and the production well is a cathode, and wherein:

the first horizontal portion and the second horizontal portion are each sectioned into a plurality of zones, each zone of the first horizontal portion is paired with a respective zone of the second horizontal portion, and a first pair of first horizontal portion zone and second horizontal portion zone is independently operable from a second pair of first horizontal portion zone and second horizontal portion zone by power of the EK-ISL being independently applied to each respective zone.

2. The system of claim 1, wherein:

the injection well is closer to the ground surface than the production well; or the production well is closer to the ground surface than the injection well.

3. The system of claim 1, wherein at least a portion of the first horizontal portion of the injection well is at a same distance to the ground surface as at least a portion of the second horizontal portion of the production well.

4. The system of claim 1, wherein:

the injection well is provided in plurality;

the production well is provided in plurality;

the plurality of injection wells and the plurality of production wells overlap as respective pairs in a depth direction; and a plurality of the pairs are provided across the area of interest.

5. The system of claim 1, wherein:

the injection well is provided in plurality;

the production well is provided in plurality; and the plurality of injection wells alternates with the plurality of production wells across the area of interest such that the plurality of injection wells and the plurality of production wells do not overlap in a depth direction.

6. The system of claim 1, wherein:

a plurality of the first horizontal portion is connected to the first vertical portion of the injection well; and a plurality of the second horizontal portion is connected to the second vertical portion of the production well.

7. The system of claim 6, wherein at least part of the plurality of the first horizontal portion of the injection well and the plurality of the second horizontal portion of the production well overlap in a depth direction.

8. The system of claim 1, wherein at least a portion of the first horizontal portion of the injection well and at least a portion of the second horizontal portion of the production well extend under a populated area, an agricultural area, or a developed area.

9. The system of claim 1, further comprising:

a plurality of control wells arranged at a periphery of the area of interest, wherein the control wells are configured to monitor groundwater in the area of interest.

10. The system of claim 1, wherein the power of the EK-ISL being independently applied to each respective zone comprises one or more of:

skipping one or more of the zones, among the plurality of zones, that are not productive;

skipping one or more of the zones, among the plurality of zones, where lixiviant could become lost in a natural fracture network of the permeable ground layer;

optimizing parameters of operation for each zone among the plurality of zones, the parameters of operation comprising one or more of: injection rate or chemical mixture;

vary the power of the EK-ISL per zone, among the plurality of zones, to use less overall power;

selectively activate respective zones among the plurality of zones; or recycle lixiviant used in a first zone, among the plurality of zones, to use for at least a second zone among the plurality of zones.

11. The system of claim 1, further comprising a sensor system configured to:

monitor the permeability of the permeable ground layer for each zone among the plurality of zones; and adjust an injection rate of the lixiviant for each zone based on the monitored permeability of the permeable ground layer in each respective zone.

12. The system of claim 1, wherein:

the lixiviant comprises a mixture of two or more different chemicals; and a ratio of the two or more different chemicals in the mixture is adjusted for each zone, among the plurality of zones, based on a composition of the target material in each respective zone.

13. A method for in-situ mining, the method comprising:

providing an injection well in an area of interest, the providing the injection well comprising:

providing a first vertical portion extending downward from a ground surface, the first vertical portion being configured to receive a lixiviant from a lixiviant source; and providing a first horizontal portion connected to the first vertical portion, the first horizontal portion extending horizontally across the area of interest through a permeable ground layer, the first horizontal portion:

receiving the lixiviant from the first vertical portion; and injecting the lixiviant into the permeable ground layer to dissolve a target material to form a solution containing the lixiviant and the target material; and providing a production well in the area of interest, the providing the production well comprising:

providing a second horizontal portion, the second horizontal portion extending horizontally across the area of interest parallel to the first horizontal portion through the permeable ground layer, the second horizontal portion receiving the solution from the first horizontal portion; and providing a second vertical portion connected to the second horizontal portion, the second vertical portion extending upward to the ground surface, the second vertical portion:

receiving the solution from the second horizontal portion; and pumping the solution to a processing plant to separate the target material from the lixiviant, wherein:

electrokinetic in-situ leaching (EK-ISL) is applied to the injection well and the production well, one of the injection well and the production well is an anode, and the other of the injection well and the production well is a cathode, and wherein:

the first horizontal portion and the second horizontal portion are each sectioned into a plurality of zones, each zone of the first horizontal portion is paired with a respective zone of the second horizontal portion, and a first pair of first horizontal portion zone and second horizontal portion zone is independently operable from a second pair of first horizontal portion zone and second horizontal portion zone by power of the EK-ISL being independently applied to each respective zone.

14. The method of claim 13, wherein:

the injection well is closer to the ground surface than the production well; or the production well is closer to the ground surface than the injection well.

15. The method of claim 13, wherein:

a plurality of control wells is arranged at a periphery of the area of interest; and the control wells monitor groundwater in the area of interest.

16. The method of claim 13, wherein:

the lixiviant is injected into the first pair of the first horizontal portion zone and the second horizontal portion zone; and simultaneously, the lixiviant is not injected into the second pair of the first horizontal portion zone and the second horizontal portion zone.

17. The method of claim 16, wherein, at a different point in time:

the lixiviant is injected into the second pair of the first horizontal portion zone and the second horizontal portion zone; and simultaneously, the lixiviant is not injected into the first pair of the first horizontal portion zone and the second horizontal portion zone.

18. The method of claim 13, wherein a composition of the solution is measured on a zone-by-zone basis.

19. The method of claim 12, wherein:

fracking or re-fracking is performed in the first pair of the first horizontal portion zone and the second horizontal portion zone; and simultaneously, the fracking or the re-fracking is not performed in the second pair of the first horizontal portion zone and the second horizontal portion zone.

* * * * *